United States Patent [19]

Staebler

[11] 4,072,449

[45] Feb. 7, 1978

[54] COMBINED SEAL BIASING SPRING AND CHECK VALVE FOR ROTARY MECHANISMS

[75] Inventor: Paul J. Staebler, Dunlap, Ill.

[73] Assignee: Caterpillar Tractor Co., Peoria, Ill.

[21] Appl. No.: 666,521

[22] Filed: Mar. 12, 1976

[51] Int. Cl.[2] ..... F01C 19/04; F01C 21/04; F04C 27/00; F04C 29/02

[52] U.S. Cl. ..... 418/87; 418/94; 418/122

[58] Field of Search ..... 418/51, 91–94, 418/122–124, 87; 123/8.01

[56] References Cited

U.S. PATENT DOCUMENTS

| | | | |
|---|---|---|---|
| 3,130,683 | 4/1964 | Paschke et al. | 418/91 |
| 3,261,334 | 7/1966 | Paschke | 418/91 |
| 3,343,526 | 9/1967 | Peras | 418/129 |
| 3,881,848 | 5/1975 | Huf | 418/123 |
| 3,923,434 | 12/1975 | Walters | 418/91 |
| 3,999,905 | 12/1976 | Goloff et al. | 418/94 |

FOREIGN PATENT DOCUMENTS

| | | | |
|---|---|---|---|
| 1,145,428 | 3/1963 | Germany | 123/8.01 |

*Primary Examiner*—John J. Vrablik

*Attorney, Agent, or Firm*—Wegner, Stellman, McCord, Wiles & Wood

[57] ABSTRACT

A rotary mechanism including a housing defining an operating chamber, a rotor journalled within the chamber, at least one seal receiving groove in the rotor, a seal within the groove, a spring within the groove and urging the seal into sealing engagement with the housing, a source of oil under pressure, and an oil conduit in fluid communication with the source and ending in an opening in the groove beneath the spring and positioned to be closed by the spring so that the spring additionally serves as a check valve opening to permit oil to enter the groove when oil under pressure is directed to the conduit and prevents pressurized gas from entering the conduit from the chamber.

5 Claims, 4 Drawing Figures

Fig. 1
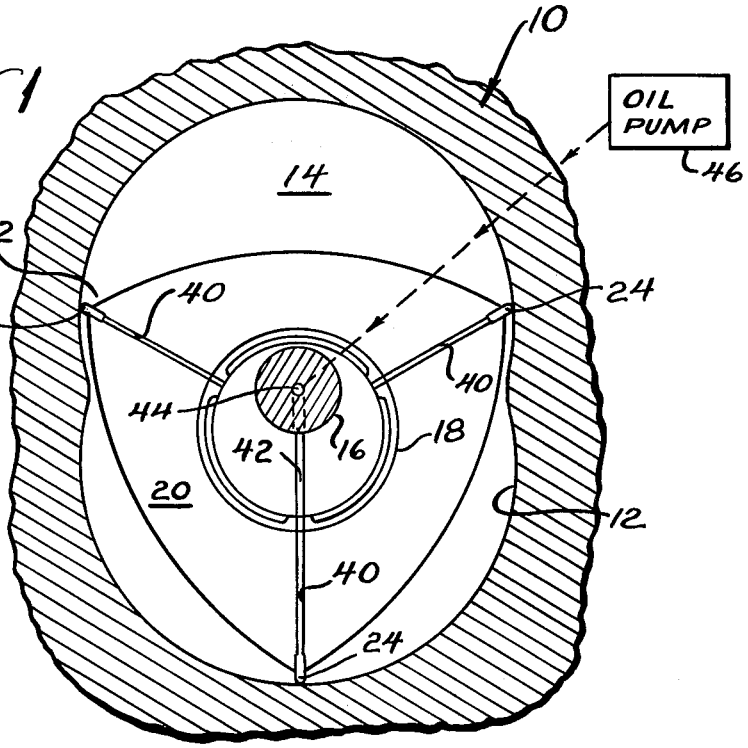
Fig. 2
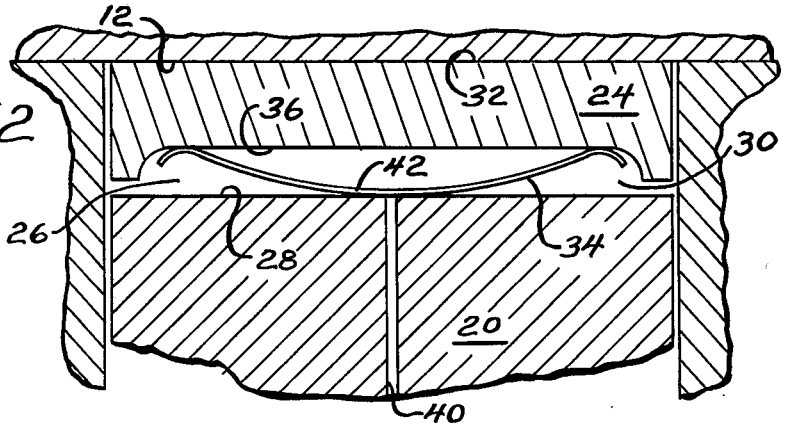
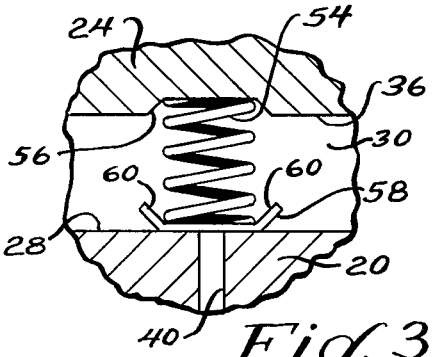
Fig. 3
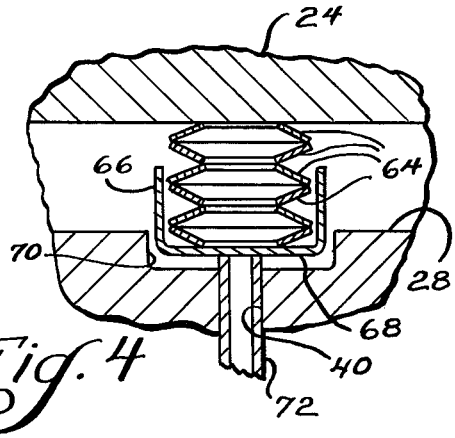
Fig. 4

COMBINED SEAL BIASING SPRING AND CHECK VALVE FOR ROTARY MECHANISMS

BACKGROUND OF THE INVENTION

This invention relates to rotary mechanisms. More specifically, it relates to improved means for lubricating seals in such mechanisms.

Prior art of possible relevance includes the following U.S. Pat. No. 3,213,837 issued Oct. 26, 1965 to Keylwert; U.S. Pat. No. 3,261,334 issued July 19, 1966 to Paschke; and U.S. Pat. No. 23,343,526 issued Sept. 26, 1967 to Peras.

In rotary mechanisms such as trochoidal mechanisms or slant axis rotary mechanisms, the biggest impediment to extensive use of the same as pumps, engines, motors, expanders, or the like, has been difficulty in achieving reliable sealing of seals such as apex seals, end seals, peripheral seals, or the like. A variety of approaches have been taken as exemplified by the above identified prior art whereby a lubricant is directed to the vicinity of the seals to minimize wear.

For example, in the above identified Paschke patent, oil flowing through cooling passages in the rotor can be directed to cup-like elements received in seal receiving grooves and closing passages. Due to minute movement of the cup-like elements during operation, the oil will be smeared on the walls of the seal receiving groove to provide lubrication.

The principal difficulty of the Paschke approach is that no means are provided whereby the quantity of oil provided to each seal receiving groove can be accurately metered. Consequently, the Paschke design can result in relatively high oil consumption.

Peras illustrates one means by which quantities of oil may be metered relatively accurately for seal lubrication purposes by means of a conduit in a rotor extending to seals and periodically alignable with a pressurized oil passage in the shaft whereby pressurized oil, during alignment of the passage and the conduit, will be directed to the seals for lubrication purposes.

To preclude backflow in the oil conduit within the rotor as well as to prevent the entry thereinto of combustion gases or gases under pressure, Peras discloses the use of check valves in connection with the conduits and passages. While this approach works relatively well, it is expensive because of the need to provide the check valve elements.

SUMMARY OF THE INVENTION

It is the principal object of the invention to provide a new and improved rotary mechanism. More specifically, it is an object of the invention to provide an improved lubrication system for seals in rotary mechanisms wherein expensive fabrication is minimized.

An exemplary embodiment achieves the foregoing object by employing seal biasing springs as check valve members. Specifically, an exemplary embodiment of the invention contemplates a rotary mechanism including a housing defining an operating chamber and a rotor journalled within the chamber. At least one seal receiving groove is in the rotor and there is a seal disposed within the groove. Spring means are disposed within the groove for urging the seal into sealing engagement with the housing and there is provided a source of oil under pressure. An oil conduit is in fluid communication with the source and ends in an opening in the groove beneath the spring means and is positioned to be closed by the spring means. Thus, the spring means additionally serves as a check valve opening to permit oil under pressure to enter the groove and prevent pressurized gas from entering the conduit from the chamber.

In a highly preferred embodiment, the mechanism includes means whereby the oil is directed to the conduit in pressurized pulses whereby the quantity of oil being consumed for seal lubrication can be metered.

In one embodiment, the spring means is defined by a leaf spring having a relatively flat portion overlying the oil opening in the groove.

According to another embodiment of the invention, the spring means is defined by a coil spring having an imperforate flap on one end overlying the opening.

According to still another embodiment, the spring means comprise stacked conical springs and a cup receiving the springs and overlying the opening.

Other objects and advantages will become apparent from the following specification taken in connection with the accompanying drawings.

DESCRIPTION OF THE DRAWINGS

FIG. 1 is a somewhat schematic sectional view of a rotary mechanism of the type wherein the invention may be advantageously employed;

FIG. 2 is an enlarged, sectional view of one embodiment of the invention;

FIG. 3 is an enlarged, fragmentary sectional view of another embodiment of the invention; and FIG. 4 is an enlarged, fragmentary sectional view of still a further embodiment of the invention.

DESCRIPTION OF THE PREFERRED EMBODIMENTS

An exemplary embodiment of an improved rotary mechanism made according to the invention is illustrated in the Figs. in connection with a trochoidal mechanism. However, it is to be understood that the invention is not limited to trochoidal mechanisms but may be advantageously employed in rotary mechanisms of other types as, for example, slant axis rotary mechanisms. It is also to be understood that the mechanism can be employed to perform a variety of functions as, for example, that of an engine, a compressor, pump, motor, expander, or the like.

An exemplary embodiment of a mechanism embodying the invention is illustrated in FIG. 1 and includes a housing, generally designated 10, having interior walls 12 and 14 plus additional walls not shown defining an operating chamber. A shaft 16 is suitably journalled by bearings (not shown) in the housing 10 and includes an eccentric 18 within the operating chamber.

A multi-apexed rotor 20 is journalled on the eccentric 18 for movement within the operating chamber and, in the embodiment illustrated, has three apices 22 at each of which there is disposed an apex seal 24 sealingly engaging the housing wall 12.

As best seen in FIG. 2, at each apex 22, there is located a seal receiving groove 26 having a bottom wall 28 and opposed side walls 30 (only one of which is shown). An apex seal 24 is disposed in each of the grooves and has a surface 32 sealingly engaging the wall 12. In the embodiment illustrated in FIG. 2, a leaf spring 34 having the shape of a shallow U is disposed in the groove 26 to be interposed between the bottom wall 28 and the underside 36 of the seal 24 to bias the seal 24 into the aforementioned sealing engagement.

The rotor 20, for each apex 22, includes an oil conduit 40 which extends to and opens in the bottom 28 of the groove 26. The leaf spring 34 is provided with a relatively flat center area 42 which overlies and closes the opening of the conduit 40.

As best seen in FIG. 1, each conduit 40 extends from its associated groove 26 to the interface of the rotor and the eccentric 18. The eccentric 18 includes a radially extending bore 42 which is periodically alignable with each of the passages 40 and which extends to a longitudinal bore 44 in the shaft 16. The bores 42 and 44 define an oil passage and are connected to an oil pump shown schematically at 46 in any conventional manner.

Thus, pressurized oil can be directed to each conduit 40, and thus to the associated seal receiving groove, whenever the associated conduit 40 is aligned with the oil passage 42. Those skilled in the art will appreciate that the relative rotation of the rotor 20 and the shaft 16 will result in only periodic alignment with the consequence that the amount of oil directed to each groove 28 will be metered by the arrangement. Varying quantities can be achieved by suitably selecting the pressure of the oil and appropriate dimensioning of the conduits 40 and the passage 42.

FIG. 3 illustrates a modified embodiment wherein the leaf spring 34 is omitted and a coil spring 54 employed in lieu thereof. To positively locate the coil spring 54, a small recess 56 is disposed in the underside 36 of the apex seal 24 for receipt of one end of the coil spring 54. The opposite end of the coil spring 54 terminates in an imperforate flap 58 which overlies the opening of the conduit 40 and acts as a check valve member. If desired, sides of the flap 58 may be upturned as at 60 so as to prevent the same from becoming disassociated from the coil spring 54.

FIG. 4 illustrates still a further embodiment wherein stacks of conical springs 64 (as, for example, so-called "Belleville" springs) are employed. A cup 66 having an imperforate bottom 68 receives the stack of the springs 64 and is nestled in a small recess 70 in the bottom 28 of the groove 26. A small sleeve 72 may be disposed in the conduit 40 to extend slightly above the bottom of the recess 70 to ensure good sealing engagement with the imperforate bottom 68 of the cup 66.

From the foregoing, it will be appreciated that a mechanism made according to the invention achieves the object of economy of fabrication by employing the seal biasing springs to perform the additional function of acting as a check valve for the lubricating system.

What is claimed is:

1. A rotary mechanism comprising:

a housing defining an operating chamber;

a rotor journalled within said chamber;

at least one seal receiving groove in said rotor;

a seal within said groove;

spring means within said groove and urging said seal into sealing engagement with said housing;

a source of oil under pressure;

an oil conduit in fluid communication with said source and ending in an opening in said groove beneath said spring means and positioned to be closed by said spring means; and means whereby oil is directed to said conduit in pressurized pulses;

whereby said spring means additionally serves as a check valve opening to permit oil to enter said groove when oil under pressure is directed to said conduit and preventing pressurized gas from entering said conduit from said chamber.

2. The rotary mechanism of claim 1 wherein said spring means is a leaf spring having a relatively flat portion overlying said opening.

3. The rotary mechanism of claim 1 wherein said spring means is a coil spring having an imperforate flap on one end and overlying said opening.

4. The rotary mechanism of claim 1 wherein said spring means comprise stacked conical springs and a cup member receiving said springs and overlying said opening.

5. A rotary mechanism comprising:

a housing defining an operating chamber;

a shaft journalled in said housing and including an eccentric within said operating chamber, said shaft including an oil passage extending to and emerging from the periphery of said eccentric;

a rotor within said chamber and journalled on said eccentric;

at least one seal receiving groove in said rotor, said groove having a bottom wall and opposed side walls;

a seal within said groove and having a sealing surface adapted to sealingly engage said housing and a second surface opposite from said sealing surface;

spring means within said groove and interposed between the bottom thereof and said second surface of said seal and urging said seal into sealing engagement with said housing; and an oil conduit within said rotor including an opening in said groove bottom beneath said spring means and positioned to be closed by said spring means, said conduit extending to said eccentric and having a port cyclically alignable with said oil passage in said eccentric periphery whereby oil under pressure in said oil passage will be periodically directed to said conduit and said spring means will act as a check valve allowing the flow of pressurized oil into said groove and precluding fluid flow in the opposite direction.

* * * * *